US006199242B1

(12) United States Patent
Masterman et al.

(10) Patent No.: US 6,199,242 B1
(45) **Date of Patent: *Mar. 13, 2001**

(54) TOOTH POLISHING BRUSH

(75) Inventors: Thomas Craig Masterman; Jean L. Spencer, both of Boston, MA (US); Donna J. Beals, Morgan Hill, CA (US)

(73) Assignee: Gillette Canada Company, Nova Scotia (CA)

( * ) Notice: Subject to any disclaimer, the term of this patent is extended or adjusted under 35 U.S.C. 154(b) by 0 days.

This patent is subject to a terminal disclaimer.

(21) Appl. No.: 08/969,690

(22) Filed: Nov. 13, 1997

Related U.S. Application Data

(63) Continuation of application No. 08/381,792, filed on Feb. 1, 1995, now Pat. No. 5,722,106.

(51) Int. Cl.[7] ..... A46B 15/00; A46D 1/00

(52) U.S. Cl. ..... 15/167.1; 15/207.2; 15/DIG. 6; 428/364; 428/373; 424/49

(58) Field of Search ..... 15/167.1, 207.2, 15/160, 159.1, DIG. 6, 167.2; 451/527; 428/373, 364, 401; 424/49; 300/21; 51/298, 295, 309

(56) References Cited

U.S. PATENT DOCUMENTS 564,497 * 7/1896 Babis ..... 15/104.9
2,110,371 * 3/1938 Radford ..... 28/1

(List continued on next page.)

FOREIGN PATENT DOCUMENTS

148726 * 7/1985 (EP) ..... 15/207.2
346646 * 12/1989 (EP) ..... 15/207.2

(List continued on next page.)

OTHER PUBLICATIONS

Plastics Technology "Lubricants and Processing Aids" pp 443–448, Jul. 1994.*
Dow Corning Corp "Coupling Agents". vol. 4 pp 284–298.*
Plastics Technology "Fillers" pp. 424–433, Jul. 1994.*
Whittaker, Clark and Daniels—Brochure (Date unknown).*
Englehard Exceptional Technologies "Specially Aluminum Silicates", Feb. 1994.*
Composition Materials Co. Inc Brochure.*

(List continued on next page.)

*Primary Examiner*—Gary K. Graham
(74) *Attorney, Agent, or Firm*—David A. Howley

(57) ABSTRACT

The present invention relates to a toothbrush with uniform diameter bristles containing a polishing agent with a particle size of from about 0.01 μm to about 100 μm, wherein cleaning of the teeth is improved without any of the adverse side effects associated with over aggressive abrasion. An embodiment of the present invention includes a toothbrush including a handle associated with a head having at least one tuft securely affixed in or attached to the head, said tuft including a plurality of filaments comprised of (a) a thermoplastic filament base material and (b) an effective polishing amount of a polishing agent having a particle size of from about 0.1 μm to about 10 μm. Particles less than 0.1 μm can be used if aggregation occurs such that the aggregate size on bristle is described. Another embodiment of the present invention includes a method of cleaning the oral cavity comprised of: (A) providing a toothbrush including a handle associated with a head having at least one tuft securely affixed in or attached to the head, said tuft including a plurality of filaments comprised of (a) a thermoplastic filament base material and (b) an effective polishing amount of a polishing agent having a particle size of from about 0.10 to about 10 microns; (B) applying an effective amount of an abrasive-free and polishing agent-free dentifrice to the free ends of said bristles; and, (C) brushing the teeth, gums, etc. of said oral cavity.

8 Claims, 5 Drawing Sheets

U.S. PATENT DOCUMENTS

| | | | | |
|---|---|---|---|---|
| 2,279,355 | * | 4/1942 | Wilensky | 15/110 |
| 2,328,998 | * | 9/1943 | Radford | 51/185 |
| 2,920,947 | * | 1/1960 | Burk et al. | 51/298 |
| 2,976,554 | * | 3/1961 | Hromoko et al. | 15/167 |
| 3,050,072 | * | 8/1962 | Diener | 132/93 |
| 3,252,775 | * | 5/1966 | Guilbert | 51/296 |
| 3,522,342 | * | 7/1970 | Nungesser et al. | 264/210 |
| 3,577,839 | * | 5/1971 | Charvat et al. | 15/179 |
| 3,613,143 | * | 10/1971 | Muhler et al. | 15/207.2 |
| 3,618,154 | * | 11/1971 | Muhler et al. | 15/167.1 |
| 3,671,381 | * | 6/1972 | Hansen | 161/180 |
| 3,977,084 | * | 8/1976 | Sloan | 52/59 |
| 4,037,369 | * | 7/1977 | Campbell | 15/207.2 |
| 4,305,234 | * | 12/1981 | Pichelman | 15/DIG. 6 |
| 4,373,541 | * | 2/1983 | Nishioka | 132/84 |
| 4,507,361 | * | 3/1985 | Twilley et al. | 428/373 |
| 4,666,323 | * | 5/1987 | Kessler | 401/129 |
| 4,712,936 | * | 12/1987 | Kessler | 401/129 |
| 4,963,046 | * | 10/1990 | Eguchi | 401/160 |
| 5,211,725 | | 5/1993 | Fowlie et al. | 51/293 |
| 5,249,961 | | 10/1993 | Hoagland | 433/1 |
| 5,273,559 | * | 12/1993 | Hammar et al. | 51/298 |
| 5,313,909 | * | 5/1994 | Tseng et al. | 116/208 |
| 5,356,978 | * | 10/1994 | Garrison | 524/400 |

FOREIGN PATENT DOCUMENTS

| | | | | |
|---|---|---|---|---|
| 2541100 | * | 8/1984 | (FR) . | |
| 1093931 | * | 12/1967 | (GB) . | |
| 1572804 | * | 8/1980 | (GB) | 15/DIG. 6 |
| 95/23539 | * | 9/1995 | (WO) . | |

OTHER PUBLICATIONS

Composition Materials Co. Inc "Plasti–Grit" Brochure.*

BSI "Specifications for Toothbrushes" BS575 (1979).

DuPont Sales Brochure, "Brush Manufacturing—TYNEX®, HEROX®, FLELOR®" (Nov. 1979).

Handbook of Chemistry and Physics, 43rd Edition (1961–1962).

Osborn Brochure, "Precision Miniature Abrasive Finishing Tools", (Aug. 1989).

Machine and Tool BLUE BOOK (May 1987).

Chart "Properties of the Man–Made Fibers", Editors of Textile Industries (1971–1972).

Rawls et al., "Toothbrush Wear", J. Dent Res. 67: Abstract 2167 (1988).

Engelhard Brochure, "Specialty Aluminum Silicates—Reinforcing Extenders for Plastic and Rubber Applications." (Oct. 1985).

Journal Of Dental Research; vol. 68, No. 12; The Measurement of Toothbrush Wear; Rawls, Mkwayi–Tulloch, Casella and Cosgrove; Dec. 1989; pp. 1781–1785.

Toothbrush Stiffness; Rawls, Mkwayi–Tulloch, and Krull; 1988 Meeting of the International Association for Dental Research; Abstract 2155; 19 pages.

Rawls Mkway–Tulloch and Krull, A Mathematical Model for Predicting Toothbrush Stiffness, *Dental Materials*, 6:111–117, Apr. 1990.

* cited by examiner

TOOTH POLISHING BRUSH

This U.S. patent application is a Continuation of U.S. patent application Ser. No. 08/381,792 filed on Feb. 1, 1995 now U.S. Pat. No. 5,722,106.

BACKGROUND OF THE INVENTION

1. The Field of the Invention

This invention relates to novel filaments (or fibers) for toothbrushes. More precisely, this invention relates to an improved filament for cleaning the oral cavity and polishing the teeth. The present invention also relates to a method of cleaning the oral cavity and polishing the teeth utilizing a brush containing said novel, improved filaments.

2. Description of the Prior Art

Commercially available toothbrushes typically have elongated handles with monofilament or co-extruded filament bristles mounted on a generally flattened, laterally-facing head at the distal end of a handle. The thin flexible bristles are smooth members of which the ends are cut off at right angles and are often rounded to dome-like tips. Toothbrushes of this type and the mechanism of toothbrushing play an important part in oral hygiene. It has been shown unequivocally that toothbrushing is instrumental in reducing dental decay. See, for example, Fosdick, L. S. *J. Am. Dent. Assoc.,* 40, 133 (1950). Furthermore, regular brushing with a cosmetic dentifrice further reduces the incidence of decay among susceptible subjects.

Regular toothbrushing with a dentifrice is further touted as being effective in reducing or preventing periodontal disease, removing food debris, and massaging the gums. Most commercial dentifrices include a mild abrasive powder to improve the composition's ability to remove adherent soiling matter, to free accessible plaque, to dislodge accessible debris and to remove superficial stain from the teeth.

Attempts have been made to embed abrasive materials or adhere abrasive materials on fiber strands for use in toothbrushes. See, for example, U.S. Pat. No. 1,470,710 to Davis and U.S. Pat. No. 5,249,961 to Hoagland. These attempts did not meet the needs of the consumer due to their tendency to (a) lose embedded abrasive; (b) abrade the gums; and (c) lack mechanical durability. Also, U.S. Pat. No. 3,618,154 to Muhler et al. describes a one piece integrally molded brush with tapered bristles. The entire brush/bristle combination is made of plastic containing up to 30% (wt.) abrasive material. This attempt has not met with success due to the difficulty of molding such a brush. In addition, molded, i.e. unoriented, bristles tend to leave poor mechanical properties, e.g. stiffness, bend recovery, etc., and tend to splay.

Also, abrasive materials have been added to the elastomeric material used in prophylactic cleaning cups. These power driven cups are used to polish and clean the teeth by a highly skilled dental practitioner. See, for example, U.S. Pat. No. 3,977,084 to Sloan and U.S. Pat. No. 5,273,559 to Hammar et al.

Attempts have been made to provide a toothbrush with a roughened irregular surface to make the bristle wall more abrasive. See, for example, U.S. Pat. No. 3,671,381 to Hansen. This attempt requires costly subsequent etching of the bristle with caustic or high pressure steam and results in a loss of mechanical properties. Others have attempted to provide bristles with more regular abrasive protrusions. See, for example, U.S. Pat. No. 4,373,541 to Nishioka. These attempts have not met with commercial success due to the inconvenience and increased processing cost associated with molding each bristle individually. Furthermore, these bristles exhibit extremely poor mechanical properties.

Abrasive containing filament materials are widely used in non-oral care, industrial applications such as metal polishing, street sweeping, vacuum cleaner brushes, etc. See, for example, U.S. Pat. Nos. 2,336,797 to Maxwell; U.S. Pat. No. 2,609,642 to Peterson; U.S. Pat. No. 2,711,365 to Price et al; U.S. Pat. No. 2,712,987 to Storrs et al; U.S. Pat. No. 2,836,517 to Gruber et al; U.S. Pat. No. 2,920,947 to Burk et al; U.S. Pat. No. 3,115,401 to Downing et al; U.S. Pat. No. 3,384,915 to Rands; U.S. Pat. No. 3,556,752 to Wilson; U.S. Pat. No. 3,577,839 to Charvat et al; U.S. Pat. No. 3,696,563 to Rands; U.S. Pat. No. 4,305,234 to Pichelman; U.S Pat. No. 4,627,950 to Matsui; U.S. Pat. No. 4,630,407 to Rhodes; U.S. Pat. No. 4,704,823 to Steinback; U.S. Pat. No. 5,016,311 to Young et al; U.S. Pat. No. 5,030,496 to McGurran; U.S. Pat. No. 5,045,091 to Abrahamson et al; U.S. Pat. No. 5,056,267 to Nicely et al; U.S. Pat. No. 5,083,840 to Young; U.S. Pat. No. 5,108,155 to Hettes et al; U.S. Pat. No. 5,211,725 to Fowlie et al; and, U.S. Pat. No. 5,227,229 to McMahan et al.

SUMMARY OF THE INVENTION

We have discovered that by fabricating a toothbrush with uniform diameter bristles containing a polishing agent with a particle size of from about 0.01 to about 100 $\mu$m, that cleaning of the teeth is improved without any of the adverse side effects associated with over aggressive abrasion. An embodiment of the present invention includes a toothbrush including a handle associated with a head having at least one tuft securely affixed in or attached to the head, said tuft including a plurality of filaments comprised of (a) a thermoplastic filament base material and (b) an effective polishing amount of a polishing agent having a particle size of from about 0.1 $\mu$m to about 10 $\mu$m. Particles less than 0.1 $\mu$m can be used if aggregation occurs such that the aggregate size on the bristle is as described.

Another embodiment of the present invention includes a method of cleaning the oral cavity comprised of: (A) providing a toothbrush including a handle associated with a head having at least one tuft securely affixed in or attached to the head, said tuft including a plurality of filaments comprised of (a) a thermoplastic filament base material and (b) an effective polishing amount of a polishing agent having a particle size of from about 0.10 to about 10 microns; (B) applying an effective amount of an abrasive-free and polishing agent-free dentifrice to the free ends of said bristles; and, (C) brushing the teeth, gums, etc. of said oral cavity.

An object of the present invention is to provide a toothbrush which overcomes the shortcomings of the prior art toothbrushes described above.

Another object of the present invention is to provide a toothbrush with improved mouth-feel.

Still, another object of the present invention is to provide a toothbrush which provides good polishing and cleaning to the teeth even when used with a non-abrasive toothpaste.

Another object of the present invention is to decrease wear and splaying.

Another object is to decrease brushing time need to achieve good oral hygiene.

Yet another object of the present invention is to provide a toothbrush bristle material with easier material handling characteristics. We have observed that the bristles utilized in the present invention may be grabbed by the picker mechanism more easily and handled more effectively during the tufting operation.

And yet another object of the present invention is to provide a bristle filament which results in a generally more uniformly rounded end (i.e., end-rounded) when processed with conventional abrasive end-rounding equipment.

These and other objects will be evident from the following:

BRIEF DESCRIPTION OF THE DRAWINGS

FIG. 5 is at a magnification of 350× and FIG. 6 is at a magnification of 1,200×.

DETAILED DESCRIPTION OF THE PRESENT INVENTION

Figure 1:
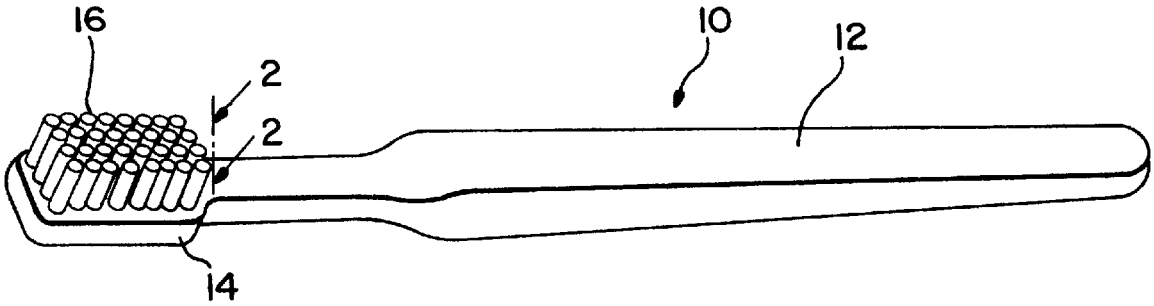
FIG. 1 is a fragmentary side elevational view of a brush which is used to illustrate the concept of the invention.

In toothbrushes of the present invention, the novel filaments are included in toothbrushes of the type shown in FIG. 1. The toothbrush shall have at least one tuft securely affixed in or attached to the head, said tuft including a plurality of filaments according to the present invention. As shown there, the toothbrush 10 includes a handle 12 and a head 14 having a plurality of tufts 16. Tufts 16 comprise a plurality of individual filaments and, tufts 16 are securely affixed in or attached to head 14 in manners known to the art. The configuration of head 14 and tufts 16 can vary and may be oval, convex curved, concave curved, flat trim, serrated "V" or any other desired configuration. Additionally, the configuration, shape and size of handle 12 or tufts 16 can vary and the axes of handle 12 and head 14 may be on the same or a different plane. The longitudinal and cross-sectional dimensions of the filaments of the invention and the profile of the filament ends can vary and the stiffness, resiliency and shape of the filament end can vary. Preferred filaments of the present invention have substantially uniform longitudinal lengths between about 0.50 to about 1.50 cm., substantially uniform cross-sectional dimensions between about 100 $\mu$m to about 350 $\mu$m and have smooth or rounded tips or ends.

Figure 2:
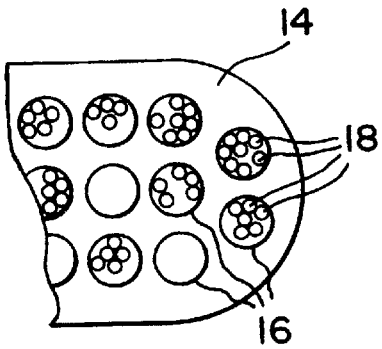
FIG. 2 is an enlarged fragmentary top plan view of the brush of FIG. 1.

Referring to FIG. 2, toothbrush bristles utilized in the present invention include a polishing agent and a thermoplastic filament base material. We have discovered that by utilizing a polishing agent with an average particle diameter of from 0.10 to about 10 microns (or the equivalent via particle aggregation) that improved cleaning performances are obtained from the toothbrush without the severe gum abrasion and enamel degradation associated with industrial abrasive filaments. As used herein, the term polishing agent refers to a material with a particle size predominantly between 0.01–100 $\mu$m and a Moh's hardness between 0.5 and 10, preferably 5 or less, and such that it does not damage the gums. Aggregates of particles smaller than 0.01 $\mu$m can also be used as long as the aggregate has a mean diameter within the claimed range.

The level of polishing agent in the bristle varies with the type of bristle base material, the diameter of the polishing agent and the type of polishing agent (hardness). Generally, the effective level of polishing agent is from about 0.2% (wt) to about 25% (wt), preferably from about 0.5% (wt) to about 5% (wt).

Polishing agents suitable for use in the present invention include:

particles of plastic;
particles of walnut shells;
particles of hardwood;
particles of corn cob;
particles of rubber;
calcium carbonate;
aragonite clay;
orthorhombic clays;
calcite clay;
rhombohedral clays;
kaolin clay;
bentonite clay;
dicalcium phosphate;
dicalcium phosphate anhydrous;
dicalcium phosphate dihydrate;
tricalcium phosphate;
calcium pyrophosphate;
insoluble sodium metaphosphate;
precipitated calcium carbonate;
magnesium orthophosphate;
trimagnesium phosphate;
hydroxyapatites;
synthetic apatites;
alumina;
hydrated alumina;
hydrated silica xerogel;
metal aluminosilicate complexes;
sodium aluminum silicates;
zirconium silicate;
silicon dioxide; and
combinations thereof.

Preferred polishing agents include: Kaolin clays, characterized as calcined or hydrated clay; alumina ($Al_2O_3$), specifically hydrated alumina manufactured by Whittaker; hydroxyapatite; silica ($SiO_2$), particularly CAB-O-SIL brand silica (silicon dioxide) manufactured by Cabot, Corp.; and combinations thereof The silicas can be precipitated silica or silica gels such as the silica xerogels described in Pader et al., U.S. Pat. No. 3,538,230, issued Mar. 2, 1970 and DiGiulio, U.S. Pat. No. 3,862,307, Jun. 21, 1975, both incorporated herein by reference. Preferred are the silica xerogels marketed under the tradename "Syloid" by the W.R. Grace & Company, Davison Chemical Division. Preferred precipitated silica materials include those marketed by the J.M. Huber Corporation under the tradename "Zeodent", particularly the silica carrying the designation "Zeodent 119". These silicas are described in U.S. Pat. No. 4,340,583, Jul. 29, 1982, incorporated herein by reference.

The most preferred polishing agent is a kaolin clay. The kaolin clay can be hydrated, like ASP 6000 brand kaolin clay, distributed by Engelhard Corp., Iselin, N.J. The kaolin clay can also be anhydrous, like Translink 555 brand kaolin clay distributed by Engel Corp., Iselin, N.J. Furthermore, the surface of the kaolin clay can be modified with a surfactant, like Translink 555 brand kaolin clay or Polarlink 5 brand kaolin clay, distributed by Polymer Valley Sciences, Akron, Ohio.

Preferred filaments of the present invention have the following characteristics at room temperature:

Diameter Range: 0.004–0.012" (100 μm–350 μm)

Coefficient of Friction: 0.01–0.90 (ASTM D3108, D3702.)

Stiffness: Soft–Medium (ISO 8627)

Tuft Retention: >3 lbs. (ASTM D638)

Bend Recovery: 80–100% (DuPont Mandrel Method)

Elongation at Break: 1–500% (ASTM D638)

Tensile Strength: 5,000–200,000 psi (ASTM D638)

Tensile and Flexural Modulus: 100,000–3,000,000 psi (ASTM D638, D790)

Most preferred filaments of the present invention have the following characteristics at room temperature:

Coefficient of Friction: 0.2–0.8

Tuft Retention: 3–10 lbs.

Bend Recovery: 90–100%

Elongation at Break: 1–200%

Tensile Strength: 5000–100,000 psi

Tensile and Flexural Modulus: 100,000–1,500,000 psi

It has been observed that the addition of the polishing agent to the bristle filament may have an effect on the stiffness of the filament. Accordingly, it is desirous to fabricate thin bristles with a high stiffness for penetrating between the teeth. This is done by adjusting the extrusion parameters and the composition of the bristle. In a preferred embodiment of the present invention, bristles have a diameter of from about 100 μm to about 350 μm, most preferably, from about 150 μm to about 200 μm, with a flex and tensile modulus stiffness of from about 100,000 to about 3,000,000 psi, preferably from about 100,000 to about 1,500,000 psi.

The bristle filaments of the present invention have a "generally uniform diameter", which means that the cross section does not vary significantly along the length of the filament. Preferably, the cross-section does not vary by more than 20%, most preferably not more than 10%, along the length of the filaments. The cross-section is preferably round, however, other shapes, e.g., square, octagonal and rectangular, are within the scope of the present invention. Also, the tip or free end of the filament can be rounded off, resulting in a general dome shape having a height to mean width ratio of less than about 1, preferably about 0.5.

Thermoplastic filament base materials according to the present invention can be any material in which said polishing agent can be dispersed and fabricated into a toothbrush bristle. Preferred thermoplastic filament base material can be any material selected from the group consisting of polyamides (e.g., Nylon 612, Amodel), acetyl resins, polyesters (e.g. polybutylene terephthalate—PBT), fluoropolymers (e.g. poly(vinylidence difluoride)—PVDF, fluorinated ethylene-propylene resin—FEP), polyacrylates, polysulfones and combinations thereof. Preferably, the thermoplastic base material is a polyamide such as DuPont or BASF filament grade polyamides; an acetyl resin such as DuPont filament grade acetyl resin; or a polyester such as DuPont, Celanese or General Electric filament grade polyester.

Other additives may also be added to the bristle material. For example, a dispersing agent may be required to keep the polishing agent adequately dispersed during the processing of the filament material. These dispersing agents can be selected from the group consisting of: magnesium stearate, zinc stearate, calcium stearate, dimethylamides of unsaturated fatty acid, fatty acids (e.g. stearic acid), fluoropolymer-based dispersants, fats (i.e. esters of glycerol), aluminum stearate, silicone oils, bisamide waxes and combinations thereof. Preferred dispersing agents are selected from the group consisting of magnesium stearate, zinc stearate, calcium stearate, bisamide waxes and combinations thereof.

Also, coupling agents may be added to the present invention to increase the interaction between the thermoplastic base material and the polishing particles; thus, keeping them in suspension and evenly dispersed during processing and also to improve tensile strength, tensile modulus and flex modulus. These coupling agents are selected from the group consisting of vinyl silane, chloropropyl silane, epoxy silane, methacrylate silane, primary amine silane, diamine silane, mercapto silane, cationic silane, cyloaliphatic expoxide silane, titanate (e.g., tris-(methacryl)isopropyl titanate) and combinations thereof. Alternatively, polishing agents such as kaolin can be coated with coupling agents such as available from Englehard.

Other additives known to those skilled in the art may be added to the bristle material such as polyethylene glycol, antioxidants, plasticizers, etc.

Although monofilaments according to the present invention are preferred, the present bristles can be prepared by a co-extrusion process wherein the outer region (sheath) contains the effective polishing agent and the core can even be free of said polishing agents. For a general discussion of co-extrusion technology, see Levy, *Plastics Extrusion Technology Handbook*, Industrial Press Inc., pp. 168–188 (1981). In addition, they can be prepared in a manner in which the reverse is true, i.e., polishing core. This type will clean only on the tip.

Figure 4:
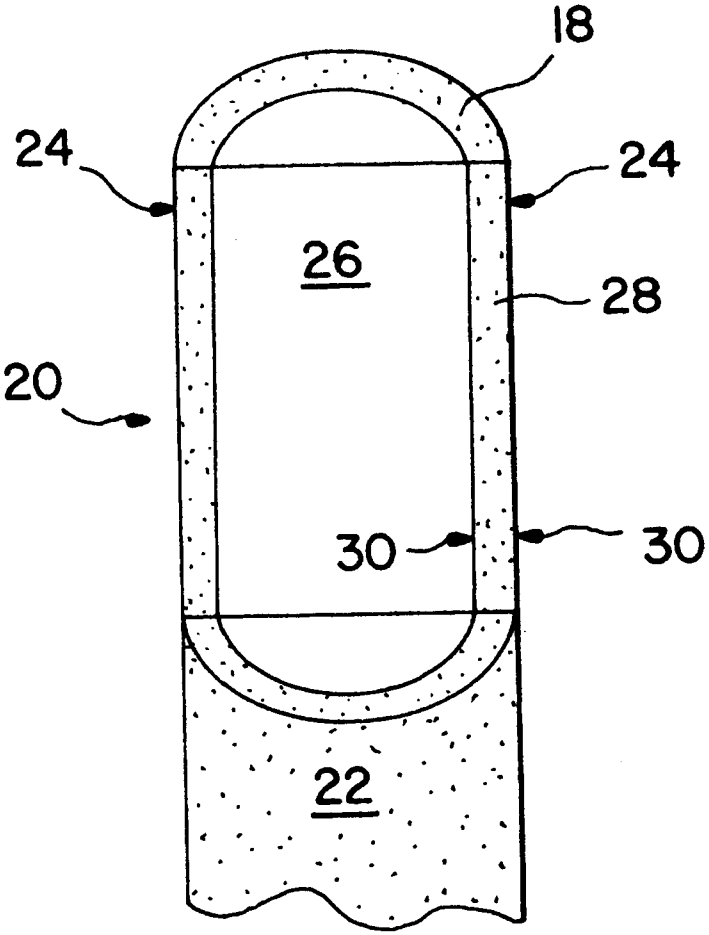
FIGS. 3 and 4 are magnified, diagrammic views of novel filaments of the invention taken along line 2—2 of FIG. 1 with a portion of the filament broken away.
Figure 3:
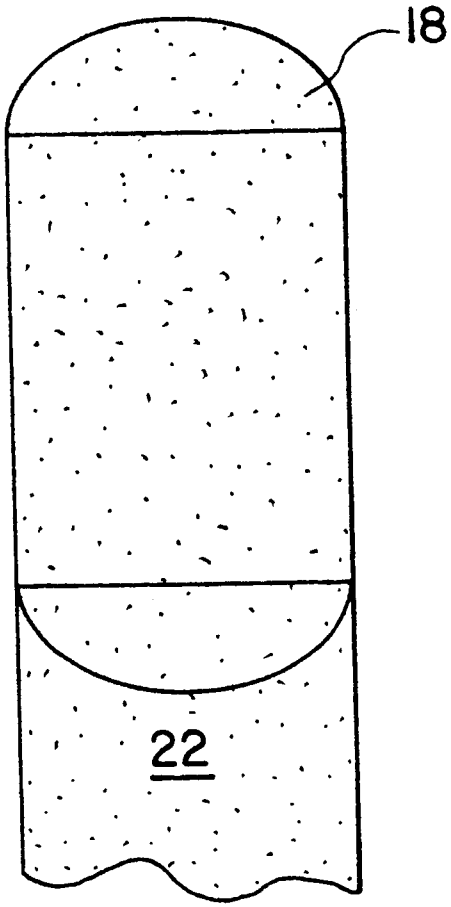
Figure 5:
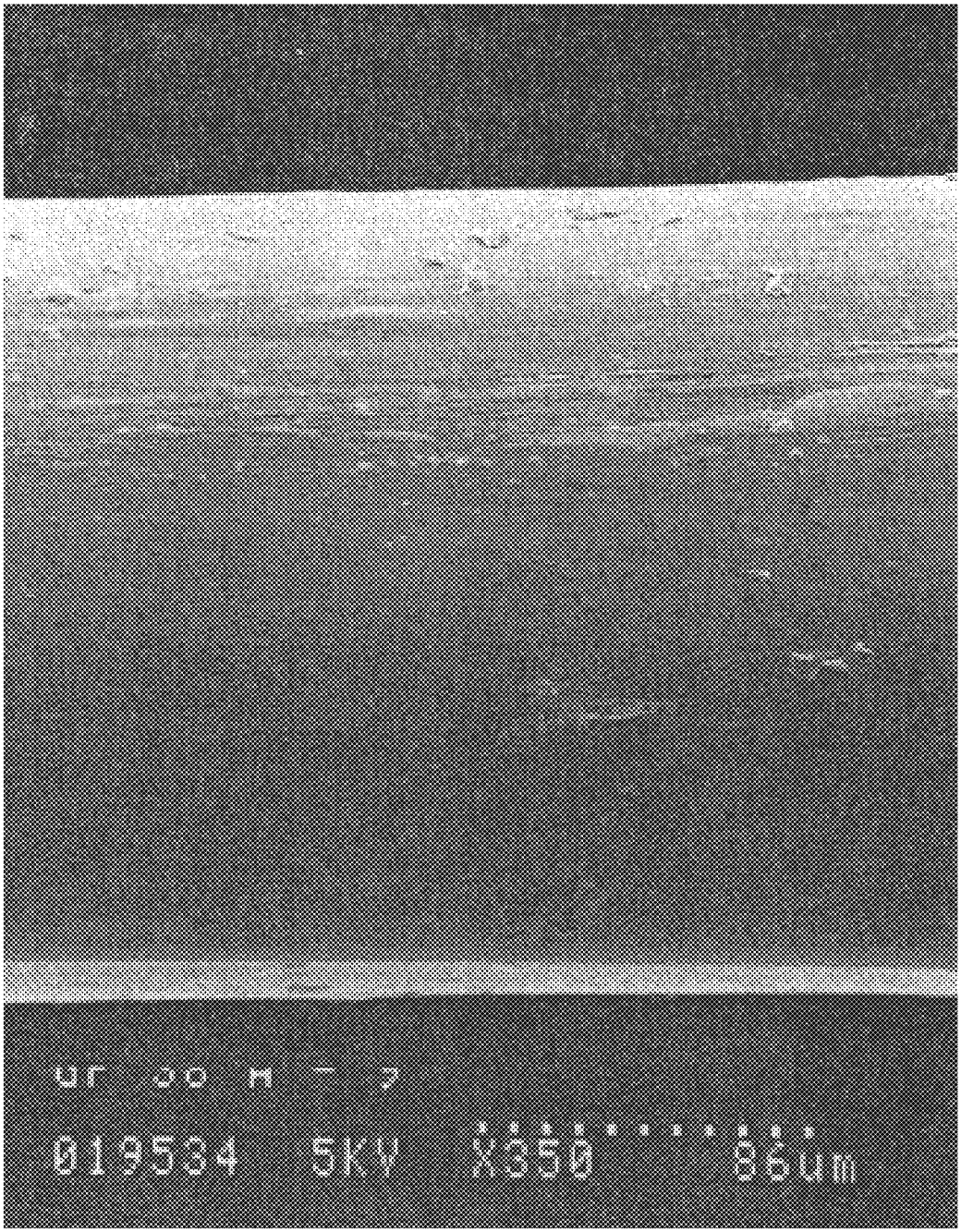
FIGS. 5 and 6 are scanning electron micrographic sectional views of the surface of filaments according to the present invention. Both filaments are Nylon 612 containing 4% hydrated Kaolin Clay having an average particle size of about 0.6 m.

FIG. 4 diagrammatically represents a preferred co-extruded filament of the present invention. Filament 20 includes longitudinal surface 22 which terminates at a tip or end 18 and defines the boundary of the cross-sectional area 24 of the filament. Cross-sectional area includes a core region 26 and a sheath region 28. The core need not contain a polishing agent. Typically, the sheath region 28 extends at least about surface 22 or preferably extends from surface 22 inwardly into a portion of cross-sectional area 24 to a distance 30 of region 28 into cross-sectional area 24. Preferably, region 28 provides an annular ring having a substantially uniform depth 30. Most preferably, this depth should not vary more than 20% from the mean depth around the annular ring. In either event, core region 26 occupies the remaining portion of the overall cross-sectional area defined by maximum diameter 24.

In an embodiment of the present invention, the two regions 26 and 28 have different color or different intensities. As used herein the term "colored region" can mean a core or sheath which is made of a plastic with a unique color. Furthermore, transparent or translucent regions are also considered to be "colored" as they are at least of different optical appearance than a truly pigmented or dyed region, as is also the case for a sheath/core of varying degrees of color intensity. It is important that the core 26 and sheath 26 materials have visually different color, e.g., white core and blue sheath, transparent core and red sheath, light red core and dark red sheath, etc. Preferred bristles according to the present invention comprise a white or transparent core and a dyed or pigmented sheath. Accordingly, sheath color region 28 provides an initial color intensity or color which is predominant and more conspicuous to the toothbrush user while the color intensity of core region 26 is less conspicuous. In response to wear produced by progressive brushing, the region 28 wears, and after sufficient wear the perceived change in color of the bristle to that of core region 26 signals the user that the filament is no longer effective.

Monofilament bristles according to the present invention can be prepared by the following general process method:

In a preferred extrusion unit according to the present invention, the system includes an extrusion die. The set also includes a ¾" Haake extruder, a cooling trough, a puller and a winder. The extruder is equipped with a screw with a L/D ratio of 25:1 and a compression ration of 3:1 and a 5 HP motor capable of operating at screw speeds and processing temperatures of up to 250 rpm and 500° C., respectively. The extruder incorporates six temperature controllers to control processing temperatures. The screw speeds are optimized to minimize interfacial shear stresses. The particular connections between these physical properties would be apparent to one skilled in the art. A gear pump is needed for diameter control.

After melt spinning, orientation and relaxation is performed directly or at sometime later. Spin finish may be necessary before this step. Orientation/relaxation involves heating and drawing-down using godets and heated ovens. The final length: initial length (draw-down ratio) may range from 1.5–10, depending upon the thermoplastic base and filler. Exact specifications would be understood by those skilled in the art. Conditioning the resulting monofilament with steam, hot water or others may be necessary, depending upon the thermoplastic base and filler.

The above extruder may be fed in any of the fashions below:

1. Pre-compounded.
   a) straight
   b) with let-down
2. Gravimetrically using 2 hoppers
3. Gravimetrically using 1 hopper.

Figure 6:
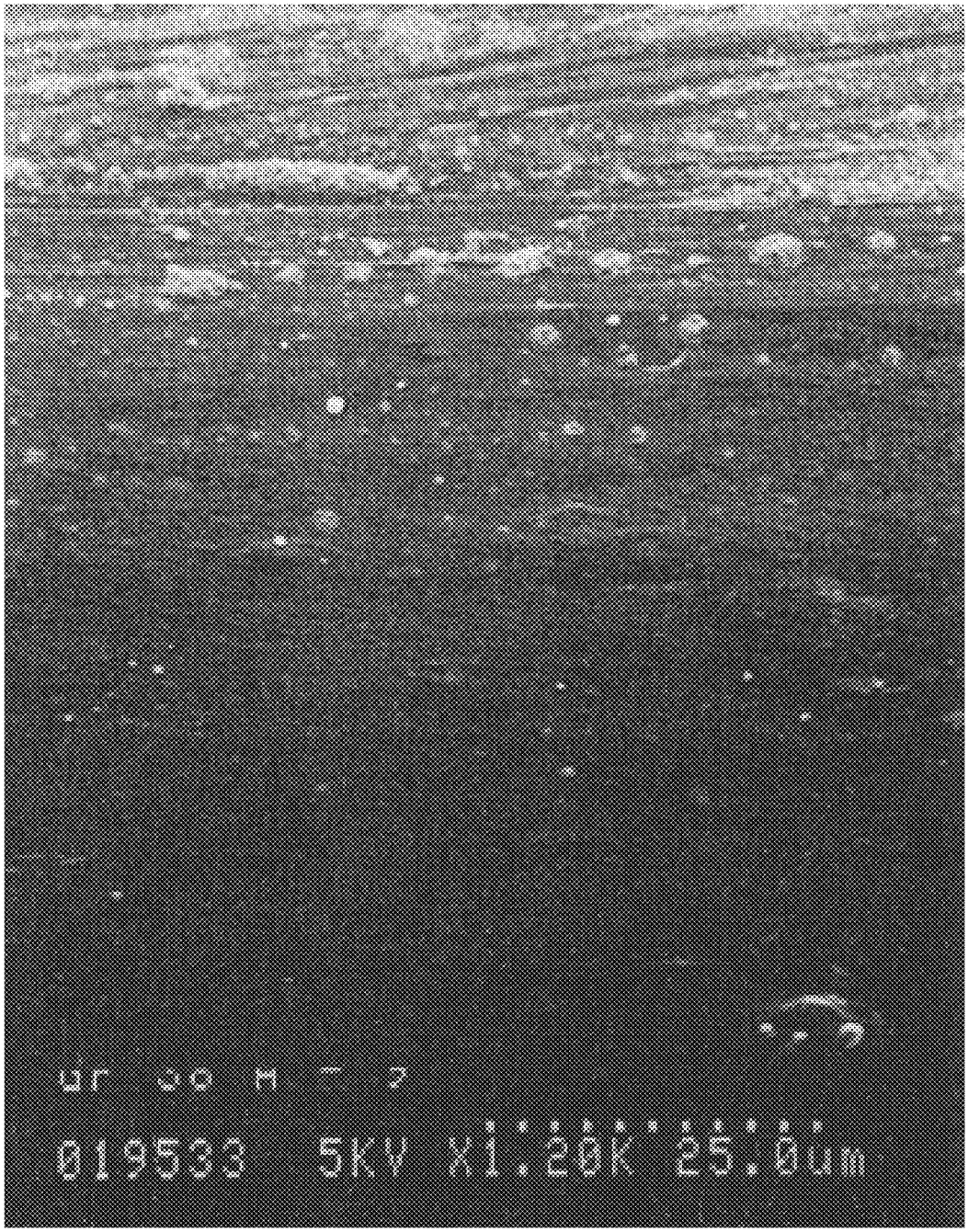
Figure 7:
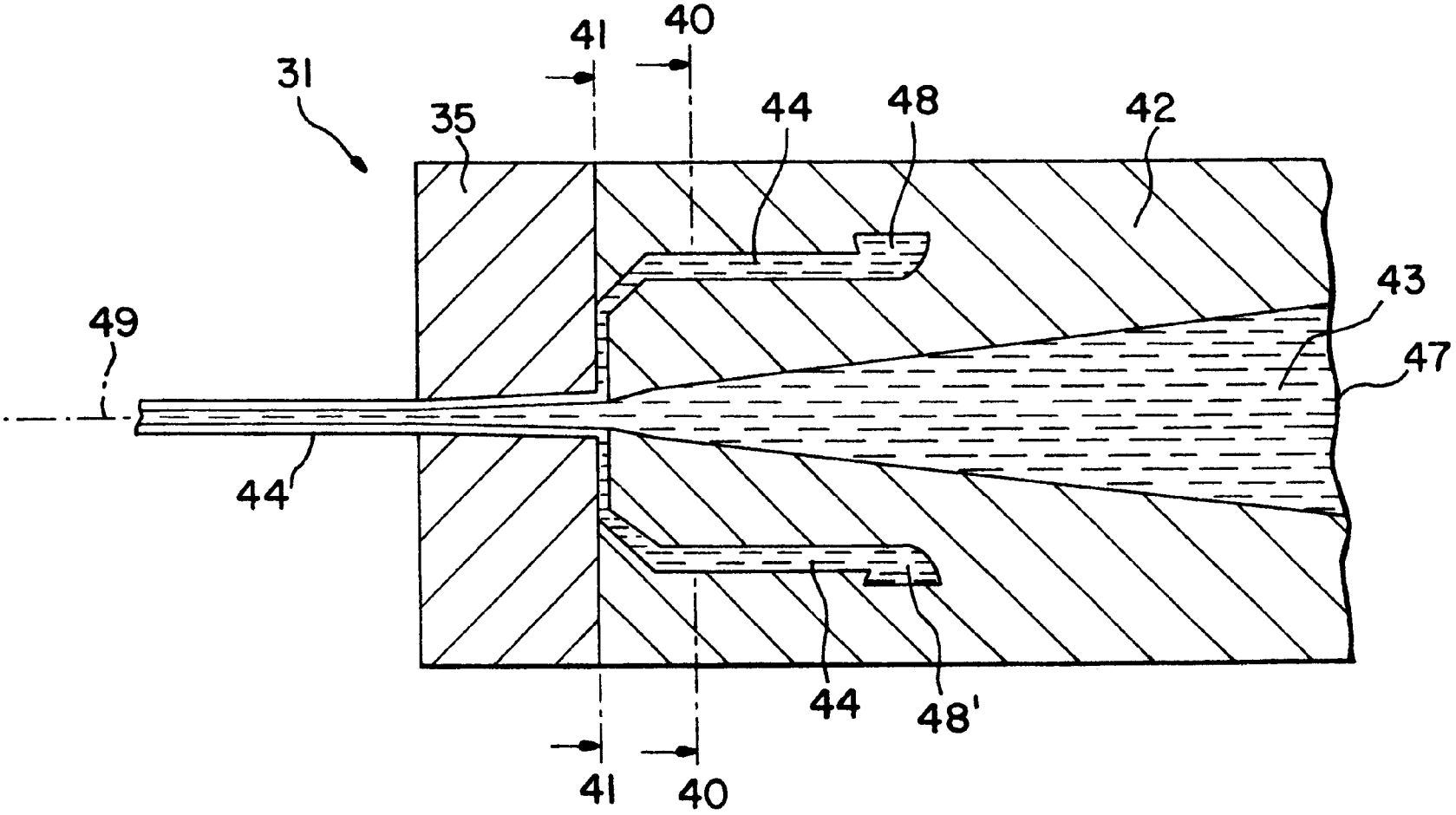
FIG. 7 is a schematic diagram depicting the co-extrusion process used to manufacture the bristle of FIG. 4.

Co-extruded bristles according to the present invention can be prepared by the following general process:

FIG. 7 shows a schematic cross-sectional view of a co-extrusion filament die 41. The die head unit comprises the core orifice 42, the sheath orifice 35. The sheath material inlet manifolds 48 and 48', and the core inlet manifold 47. Typically the entire die is heated. The best condition for making co-extruded bristles is to have the melt viscosity of both resins, core 43 and sheath 44, as close together as possible at the point of stream combination. This results in the minimum disturbance at the interface between the two materials and results in a clear line of demarcation along the cross-sectional area at a magnification of about 250×. A sharp interface between the core and the sheath can also be produced by adjusting contact time, material grades or by using different resins. This can clearly be seen in photomicrograph FIG. 6.

In a preferred co-extrusion unit according to the present invention, the system includes a co-extrusion die as shown in FIG. 7 which includes a cross head sheath die which rotates about the axis of extrusion 49. The set up also includes two ¾" Haake extruders, a cooling trough, a puller and a winder. Each extruder is equipped with a screw with a L/D ratio of 25:1 and a compression ratio of 3:1 and a 5 HP motor capable of operating at screw speeds and processing temperatures of up to 250 rpm and 500° C., respectively. Each extruder incorporates six temperature controllers to control processing temperatures.

As an example, when nylon is used, the extrusion die has a core orifice 42 with an exit diameter of 0.080 inches and a sheath orifice 42 without exit diameter of 0.080 inches and a sheath orifice 35 with an exit diameter of 0.085 inches. The core melt 43 is uncolored nylon (Zytel 158L) and the sheath melt 44 is an uncolored nylon containing 3% kaolin particles. Both melts and the die 31 are maintained at a temperature of 190° C.–230° C. The core extruder operates at 20 rpm, 608 psi, and 5263 m.gm torque. The screw speeds are optimized to minimize interfacial shear stresses. The particular connections between these physical properties would be apparent to one skilled in the art. Furthermore, a full production line in this area will also include additional processing hardware for orienting (draw process), annealing and finishing.

Finally, to produce a 0.008" filament from the above extrusion dye (orifice equals 0.085") the draw down ratio is set at 10.625:1. By employing this technique the thickness of the outer sheath layer 26 ranges from 0.0001" to 0.0004", and can be produced at a thickness of 0.0002" plus or minus 20%, typically plus or minus 10%. This highly uniform coating layer thickness is achieved by optimizing the ratio of the two extruder speeds and cross-head design. For example, to extrude the above-mentioned 0.008" nylon bristles with a layer thickness of 0.0002", the ratio of the screw speed (sheath/core) is set at 10:1. Increasing the ratio results in a thinner outer layer up to a point when the outer layer becomes discontinuous, while increasing both screw speeds increases dye pressure and ends up degrading polymeric material. On the other hand reducing both screw speeds lowers the die pressure but reduces input. Optionally a gear pump can be added to meter the materials more precisely.

As mentioned previously, the die may incorporate a rotating sheath orifice 45 to produce a more uniform coating on the filament. The technique involves rotating the outer frame (sheath frame) of a co-extrusion die of from about 0.5 to about 50 RPM's depending on the rheological properties of the polymer used for forming the outer layer. When coating nylon bristles like the ones described above, a rotational speed of from about 0.5 to about 10.0 is utilized, most preferably from about 0.5 to about 5.0. A chain sprocket is added to the dye for the frame rotation. During the filament co-extrusion the sprocket is rotated at a set speed controlled by a motor with a chain drive. This is depicted as the rotation arrow 39 in FIG. 10. This frame rotation helps disperse the melt stream in the outer layer, thereby producing a uniform ultra thin layer. When the sheath screw speeds are metered back, discontinuous sheath coatings are produced. On a rotating die, this results in a swirling stripe around the filament similar to a barber's pole. Either of these concepts could also be used as a wear indicating bristle.

Applicants consider equivalent embodiments to be part of the present invention. For example, non-circular bristles such as square, hexagonal, or other geometric cross sections are also contemplated by the present invention. Still further, the filaments of the present invention can also be used in power-driven toothbrushes, i.e., "electric toothbrushes". Also, crimped bristle filaments are also considered within the scope of the present invention. The invention and manner of making and using the invention will be more fully appreciated from the following non-limiting, illustrative examples:

EXAMPLES

The following filaments were prepared using the general method described below and the following test results were attained on raw filaments and from brushes made therefrom.

Extrusion Process

1. Ingredients are introduced to the hopper of a Davis-Standard single screw extruder with a 2 inch screw (manufactured by Crompton & Knowles Corp., Conn.). Temperature range for Nylon or polybutylene terephthalate (PBT) polyester is 500–550° F.
2. Materials are fed at a rate of about 100 pounds per hour. The melt is metered through filters and melt pumps and forced through heated die systems.
3. Hot melt is cooled, heated to a softening point and drawn, annealed and collected. Temperatures, pressures and drawing ratios are adjusted in accordance with the material being processed.

| | | | | | Filament Properties | | | | Brush Properties | |
|---|---|---|---|---|---|---|---|---|---|---|
| Sample ID | Plastic | Laolin | Acrawax C | Diameter (Inches) | DuPont Mandrel Bend Recovery (%) | Tensile Modulus (kpsi) | Tensile Strength (kpsi) | Elongation at Break (%) | Wear Index | In vitro plaque Removal (% buccal/% gingival) |
| A | 6.12 Nylon | 2% Kaolin ASP-600 | 0.15% | .008 | 95.8 | 533 | 57 | 40 | | |
| B | 6.12 Nylon | 4% Kaolin ASP-600 | 0.15% | .008 | 95.5 | 511 | 51 | 30 | | |
| C | 6.12 Nylon | 4% Kaolin ASP-600 | 0 | .008 | 96.2 | 490 | 49 | 27 | | |
| C2 | 6.12 Nylon | 2% Kaolin ASP-600 | 0 | .008 | 95.9 | 522 | 57 | 43 | | |
| D | 6.12 Nylon | 2% Kaolin Satintone 5 | 0.15% | .008 | 95.7 | 510 | 51 | 34 | | |
| G-8 | 6.12 Nylon | 2% Kaolin Translink 555 | 0.15% | .008 | 95.8 | 529 | 55 | 37 | | |
| G-7 | 6.12 Nylon | 2% Kaolin Translink 555 | 0.15% | .007 | 95.3 | 528 | 54 | 32 | | |
| I-8 | 6.12 Nylon | 2% Kaolin Polarlink 5 | 0.15% | .008 | 95.7 | 523 | 55 | 36 | | |
| I-7 | 6.12 Nylon | 2% Kaolin Polarlink 5 | 0.15% | .007 | 95.4 | 540 | 56 | 34 | | |
| J-7 | PBT Poly-ester | 2% Kaolin Translink 555 | 0.15% | .007 | 94.3 | 519 | 49 | 38 | | |
| J-6 | PBT Poly-ester | 2% Kaolin Translink 555 | 0.15% | .006 | 94.4 | 573 | 53 | 36 | | |
| 1 | PBT Poly-ester | 0.2% Cabosil | 0.15% | .006 | 95.1 | 533 | 52 | 48 | | |
| 2 | PBT Poly-ester | 0.2% Cabosil | 0.15% | .007 | 94.9 | 534 | 52 | 41 | | |
| 3 | PBT Poly-ester | 0.4% Cabosil | 0.15% | .007 | 94.7 | 529 | 51 | 37 | | |
| 4 | PBT Poly-ester | 0.4% Cabosil | 0.15% | .006 | 95.5 | 522 | 51 | 43 | | |
| 5 | PBT Poly-ester | 0.8% Cabosil | 0.15% | .006 | 95.9 | 536 | 48 | 32 | | |
| 6 | PBT Poly-ester | 0.8% Cabosil | 0.15% | .007 | 95.8 | 510 | 44 | 28 | .157 | 80/76 |
| 7 | 6.12 Nylon | 0.2% Cabosil | 0.15% | .007 | 96.9 | 502 | 57 | 45 | | |

-continued

| | | | | | Filament Properties | | | | Brush Properties | |
|---|---|---|---|---|---|---|---|---|---|---|
| Sample ID | Plastic | Laolin | Acrawax C | Diameter (Inches) | DuPont Mandrel Bend Recovery (%) | Tensile Modulus (kpsi) | Tensile Strength (kpsi) | Elongation at Break (%) | Wear Index | In vitro plaque Removal (% buccal/% gingival) |
| 8 | 6.12 Nylon | 0.2% Cabosil | 0.15% | .008 | 96.3 | 489 | 56 | 47 | .186 | |
| 9 | 6.12 Nylon | 0.4% Cabosil | 0.15% | .008 | 96.2 | 481 | 54 | 42 | | |
| 10 | 6.12 Nylon | 0.4% Cabosil | 0.15% | .007 | 96.7 | 489 | 54 | 42 | | |
| 11 | 6.12 Nylon | 0.8% Cabosil | 0.15% | .007 | 96.8 | 500 | 55 | 41 | | |
| 12 | 6.12 Nylon | 0.8% Cabosil | 0.15% | .008 | 96.6 | 490 | 52 | 35 | .128 | 76/63 |

Note:
ASP 600 = Engelhard hydrated Kaolin, 0.6 μm average particle size and 0.1–6 μm range, Iselin, NJ
Satintone 5 = Engelhard hydrated Kaolin with aminosilane surfactant, 0.8 μm average particle size and 0.2–6 μm range, Iselin, NJ
Polarlink = Polymer Valley Distribution hydrated Kaolin, .45 micron mean particle size with Mercapto silane treatment, Manufactured by Polymer Valley Sciences, Akron, OH
Translink 555 = Engelhard surface modified anhydrous Kaolin, 0.8 μm average particle size and 0.2–6.0 μm range
Acrawax C = N,N'Ethylene Bisstearamide (used as a dispersing agent) manufactured by Lonza Chemicals, Fair Lawn, NJ
Cabosil = Amorphous fumed silica (silicon dioxide) M-7D, .014 microns, Davison Chemical Division of W. R. Grace Co.

What is claimed is:

1. A toothbrush including a handle extending from a head having at least one tuft secured to the head, said tuft including a plurality of elongated filaments each having a length and a generally uniform diameter comprised of:

(a) a thermoplastic filament base material; and, (b) an effective polishing amount of a polishing agent in contact with said base material and having a particle size of from about 0.10 micron to about 10 microns, wherein said filaments are characterized by:

a diameter in the range of from about 100 to about 350 μm;

a coefficient of friction of from about 0.01 to about 0.90;

an ISO stiffness rating of Soft to Medium;

a tuft retention greater than 3 lbs.;

a bend recovery of from 80% to 100%;

an elongation at break of from about 1% to about 500%;

a tensile strength of from about 5,000 to about 200,000 psi; and a tensile and flexural modulus of from about 100,000 to about 3,000,000 psi, wherein the diameter of said filaments does not vary more than 20% along the length of said filaments and wherein said polishing agent is selected from the group consisting of: particles of plastic; particles of walnut shells; particles of hardwood; particles of corn cob; particles of rubber; calcium carbonate; aragonite clay; orthorhombic clays; calcite clay; rhombohedral clays; kaolin clay; bentonite clay; dicalcium phosphate; dicalcium phosphate anhydrous; dicalcium phosphate dihydrate; tricalcium phosphate; insoluble sodium metaphosphate; precipitated calcium carbonate; magnesium orthophosphate; trimagnesium phosphate; hydroxyapatites; synthetic apatites; alumina; hydrated alumina; hydrated silica xerogel; metal aluminosilicate complexes; sodium aluminum silicates; zirconium silicate; and combinations thereof.

2. A toothbrush according to claim 1 wherein said filaments contain from about 0.5% (wt) of said polishing agent to about 25% (wt), said polishing agent having a particle size of from about 0.1 to about 10 wherein said polishing agent is selected from the group consisting of kaolin, alumina, hydroxyapatite, and combinations thereof and wherein the filament base material is selected from the group consisting of polyamides, acetyl resins, polyesters, fluoropolymers, polyacrylates, polysulfones and combinations thereof.

3. A toothbrush according to claim 2 wherein said filament further comprises a dispersing agent selected from the group consisting of magnesium stearate, zinc stearate, calcium stearate, dimethylamides of unsaturated fatty acid, fatty acids, fluoropolymer-based dispersants, fats, aluminum stearate, silicone oils, bisamide waxes and combinations thereof wherein said filament further comprises a coupling agent selected from the group consisting of vinyl silane, chloropropyl silane, epoxy silane, methacrylate silane, primary amine silane, diamine silane, mercapto silane, cationic silane, cyloaliphatic expoxide silane, titanate and combinations thereof.

4. A toothbrush according to claim 3 wherein said polishing agent extends along the entire length of the filaments.

5. A toothbrush according to claim 4 wherein said polishing agent is kaolin clay and said filament base material is polyester.

6. A toothbrush according to claim 5 wherein said dispersing agent is calcium stearate and said coupling agent is vinyl silane.

7. A toothbrush according to claim 1, wherein said filaments are characterized by a bend recovery of from about 90% to 100%.

8. A toothbrush including a handle extending from a head having at least one tuft secured to the head, said tuft including a plurality of elongated filaments each having a length and a generally uniform diameter comprised of:

(a) a thermoplastic filament base material; and, (b) an effective polishing amount of polishing agent in contact with said base material and having a particle size of from about 0.10 micron to about 10 microns, said polishing agent being selected from the group consisting of kaolin, hydroxyapatite and combinations thereof, wherein the diameter of said filaments does not vary more than 10% along the length of said filaments, wherein said polishing agent has a Moh's hardness of from about 0.5 to about 10, wherein said filaments contain from about 0.5% (wt) to about 25% (wt) of said polishing agent, wherein the filament base material is selected from the group consisting of polyamides, acetyl resins, polyesters, fluoropolymers, polyacrylates, polysulfones and combinations thereof, wherein said polishing agent is generally dispersed throughout said filament, wherein said filaments further comprise a dispersing agent selected from the group consisting of magnesium stearate, zinc stearate, calcium stearate, dimethylamides of unsaturated fatty acid, fatty acids, fluoropolymer-based dispersants, fats, aluminum stearate, silicone oils, bisamide waxes and combinations thereof, wherein said filaments are characterized by:

a diameter in the range of from about 150 to about 200 um;

a coefficient of friction of from about 0.20 to about 0.80;

a bend recovery of from 90% to 100%;

an elongation at break of from about 1% to about 200%;

a tensile strength of from about 5,000 to about 100,000 psi; and a tensile and flexural modulus of from about 100,000 to about 1,500,000 psi.

* * * * *